US007628279B2

(12) United States Patent
Sekiguchi et al.

(10) Patent No.: US 7,628,279 B2
(45) Date of Patent: Dec. 8, 2009

(54) CURRENCY SORTER

(75) Inventors: Junichi Sekiguchi, Himeji (JP); Yasushi Yokota, Himeji (JP); Akito Kuroda, Himeji (JP); Yoshifumi Kawabata, Himeji (JP)

(73) Assignee: Glory Kogyo Kabushiki Kaisha, Himeji-Shi, Hyogo-Ken (JP)

( * ) Notice: Subject to any disclaimer, the term of this patent is extended or adjusted under 35 U.S.C. 154(b) by 501 days.

(21) Appl. No.: 11/243,268

(22) Filed: Oct. 4, 2005

(65) Prior Publication Data

US 2006/0076213 A1 Apr. 13, 2006

(30) Foreign Application Priority Data

Oct. 4, 2004 (JP) ..... 2004-291409
Mar. 23, 2005 (JP) ..... 2005-084426

(51) Int. Cl.
*B07C 5/00* (2006.01)
*G07F 7/04* (2006.01)

(52) U.S. Cl. ..... 209/534; 194/206

(58) Field of Classification Search ..... 209/534; 194/206, 207; 902/8, 9, 11, 12; 414/789.9, 414/790.2, 280, 331.1, 331.18
See application file for complete search history.

(56) References Cited

U.S. PATENT DOCUMENTS 4,017,004 A * 4/1977 Onoe et al. ..... 221/94
4,025,420 A 5/1977 Horino ..... 209/74 R
4,745,266 A * 5/1988 Miura ..... 235/379

(Continued)

FOREIGN PATENT DOCUMENTS

EP 0 871 149 A1 10/1998

(Continued)

OTHER PUBLICATIONS

European Search reported issued Jan. 30, 2006 in European Application No. EP 05 25 6196.6-2211.

*Primary Examiner*—Patrick H Mackey
*Assistant Examiner*—Mark Hageman
(74) *Attorney, Agent, or Firm*—Renner, Kenner, Greive, Bobak, Taylor & Weber

(57) ABSTRACT

A currency sorter has: take-in means (106) for taking currency notes in sorter one by one; discriminating means (105) for discriminating the currency notes; stacking means (111 to 115) for stacking the currency notes according to the discrimination result obtained by said discriminating means; bundling means (200) for bundling a predetermined number of the currency notes; a money returning unit at which an odd currency note which is a fraction of the predetermined number of the currency notes is returned, first conveyer means for conveying the predetermined number of the currency notes from all deposited in said stacking means with grabbing them to the bundling means; and second conveyer means for conveying the odd currency notes left in the stacking means with grabbing them to said money returning unit. The sorter may further have printing means (212) for imprinting predetermined information on a band supplied to said bundling means; and print control means (400) for controlling said printing means imprint information indicating one of stacking means from which the currency notes are derived, whether stacked currency notes are mixture of the new and old versions or discriminatively stacked new or old version or whether the currency notes are mixture of the fit and unfit conditions or discriminatively stacked fit and unfit condition.

6 Claims, 9 Drawing Sheets

U.S. PATENT DOCUMENTS 4,820,909 A * 4/1989 Kawauchi et al. ..... 235/379
4,825,378 A 4/1989 Yuge ..... 364/478
5,019,249 A * 5/1991 Sugai et al. ..... 209/534
5,101,979 A * 4/1992 Uno et al. ..... 209/534
5,522,511 A 6/1996 Sakoguchi et al. ..... 209/534
6,036,089 A * 3/2000 Oguchi et al. ..... 235/379
6,070,398 A * 6/2000 Neri ..... 53/582
6,516,998 B2 * 2/2003 Calder et al. ..... 235/381
6,568,154 B1 5/2003 Lundblad et al. ..... 53/411

FOREIGN PATENT DOCUMENTS

JP 2002197509 * 12/2002

* cited by examiner

OLD VERSION TREATED AS NORMAL SELECTABLE DENOMINATION

| MODE | PROCESS | DENOMINATIONS | CONDITIONS | VERSIONS | EXTERNAL STACKING UNIT |
|---|---|---|---|---|---|
| BUNDLING (DEFAULT) | 1 DENOMINATION | 1 OUT OF 4 (10000, 5000, 2000, 1000) | SELECT ONE FROM (FIT / UNFIT, MIXED FIT, MIXED UNFIT) DEFAULT: FIT | SELECT ONE FROM (NEW, OLD, NEW AND OLD) DEFAULT: NEW | SELECT ONE FROM MIXED, DISCRIMINATIVE FIT / UNFIT, DISCRIMINATIVE NEW / OLD DEFAULT: MIXED |
| | 2 DENOMINATIONS | 2 OUT OF 4 (10000, 5000, 2000, 1000) DEFAULT: 10000 AND 1000 | | | |
| | 3 DENOMINATIONS | 3 OUT OF 4 (10000, 5000, 2000, 1000) DEFAULT: 10000, 5000 AND 1000 | | | |
| | 4 DENOMINATIONS | 10000, 5000, 2000 AND 1000 ARE SELECTED | | | |

FIG. 6

| (NEW / OLD SEPARATION) | (NEW / OLD MIXED) |
|---|---|
| A: FIRST STACK UNIT | G: FIRST STACK UNIT |
| B: SECOND STACK UNIT | H: SECOND STACK UNIT |
| C: THIRD STACK UNIT | I: THIRD STACK UNIT |
| D: FOURTH STACK UNIT | J: FOURTH STACK UNIT |
| E: FIFTH STACK UNIT | K: FIFTH STACK UNIT |

| (FIT / UNFIT SEPARATION) | (FIT / UNFIT MIXED) |
|---|---|
| O: FIRST STACK UNIT | V : FIRST STACK UNIT |
| P: SECOND STACK UNIT | W: SECOND STACK UNIT |
| Q: THIRD STACK UNIT | X: THIRD STACK UNIT |
| R: FOURTH STACK UNIT | Y: FOURTH STACK UNIT |
| S: FIFTH STACK UNIT | Z: FIFTH STACK UNIT |

FIG. 9

| (NEW / OLD SEPARATION AND FIT / UNFIT SEPARATION) | (NEW / OLD MIXED AND FIT / UNFIT SEPARATION) | (NEW / OLD SEPARATION AND FIT / UNFIT MIXED) | (NEW / OLD MIXED AND FIT / UNFIT MIXED |
|---|---|---|---|
| A: FIRST STACK UNIT | G: FIRST STACK UNIT | O: FIRST STACK UNIT | V :FIRST STACK UNIT |
| B: SECOND STACK UNIT | H: SECOND STACK UNIT | P: SECOND STACK UNIT | W: SECOND STACK UNIT |
| C: THIRD STACK UNIT | I: THIRD STACK UNIT | Q: THIRD STACK UNIT | X: THIRD STACK UNIT |
| D: FOURTH STACK UNIT | J: FOURTH STACK UNIT | R: FOURTH STACK UNIT | Y: FOURTH STACK UNIT |
| E: FIFTH STACK UNIT | K: FIFTH STACK UNIT | S: FIFTH STACK UNIT | Z; FIFTH STACK UNIT |

FIG.10

CURRENCY SORTER

FIELD OF THE INVENTION

The present invention relates to a currency sorter, and more particularly, to the one that serves to take in mixed currency deposited in sheets, discriminate, sort them out denominations, face values, or versions, put them into stacking units, and bundle a predetermined number of the notes.

BACKGROUND ART

In financial companies and organizations, a currency sorter is generally used to facilitate organizing and handling deposited currency notes. When a bunch of currency notes of normal and unfit conditions and of various face amounts together are deposited (normal notes are referred to as "fit notes" hereinafter while "unfit notes" means those which are significantly fatigue due to grime and breakage), such a currency sorter serves to sort the currency notes according to their respective denominations and fit/unfit conditions and then bundle a hundred of the notes, for example, with a band.

A prior art sorter of the similar type can handle at most the currency notes of only three face values of 1,000 yen, 5,000 yen, and 10,000 yen, for instance, and the typical sorter is disclosed in Japanese Utility Model Registration No. 2597752 (Patent Document 1).

The Patent document 1 describes a sorter that includes the external stacking units for the currency notes of the above-identified face values and two built-in stacking units. When odd notes which are fractions of a predetermined number of the currency notes are still left in the stacking units subsequent to bundling the last of a hundred of them, the stacking units are eventually evacuated by removing the odd notes.

In the currency sorter disclosed in Japanese Patent Laid-open Publication No. 2003-141606 (Patent Document 2), data such as a name of the financial company or organization, a branch office number, a date of handling, and the like are generally printed on the bundling band of individual bundles of the currency notes, and it is processed that a serial number is given to each bundle to specify it.

The Patent Document 2, namely, discloses a manner in which a printing means is used to imprint process information data showing how the bundle of the currency notes have been processed in each handling and processing units. Specifically, the printed process information data gives information about whether the bundle of the notes are derived from an external stacking units or from a built-in stacking units and/or information about whether they are bundled notes to be released or to be stacked.

The Patent Document 2 also discloses a manner in which the printed process information data on the bundle of the currency notes is so specific as to give information about time when the bundle was processed. This permits a staff member to track the time when the bunch of the notes were bundled, from the printed letters on the bundling band. Additionally, the invention also teaches that the bundling band contains a printed data on an operator to give definite information about who was in charge of processing the bundle of the notes.

However, it is an annoying task to evacuate a fraction of the predetermined number of the currency notes from the stacking unit. Actually, the operator, after opening a front door of the sorter by a hand, must peep into the sorter to seek for the currency notes left in the stacking unit and then thrust his or her arm through a narrow clearance around the door to grasp and take out the notes.

On the other hand, if the various process information data were put on the bundling band, it is difficult to diagnose various malfunctions caused during the bundling.

Such malfunctions apt to occur during the bundling are often resulted from some troubles caused in the previous stage during putting the currency notes in stacking. For instance, it is empirically known regarding the frequently caused bundling failure that the currency notes have often their corner bent due to a switch nail in the course of conveying them into the stacking units, and/or an organizing mechanism fails to put the notes into an orderly heap in the stacking units, either case of which results the currency notes in being stacked so awkwardly as to lead to unsatisfactory results of the bundling.

If it can be supposed from the bundling band how the bundling failure occurred due to the currency notes lousily stacked in stacking, it is still unknown which stacking unit is the place that developed the bundling failure, and this makes a diagnosis of the malfunction difficult.

In a sorter with means adapted to switch a sorting manner between sorting out new and old versions of the currency and bundling the mixed currency notes without discrimination of the versions, one cannot tell any specific bunch is of the mixed currency notes till all the notes in the bunch are checked. In the case that all but one in the bunch are the notes of the new version, since the setting contents cannot be known, it is hard to track how the single note of the old version was immixed and also hard to presume if it is as a result of the selected sorting manner or rather of failure in the sorting, or of the existence of some bugs in administrative software program. This kind of trouble is caused not only in handling the mixed currency of the new and old versions but In the case of a sorter with the discriminatively switching means for sorting out the fit and unfit conditions to bundle them in separate bundles or bundling the mixed notes together.

SUMMARY OF THE INVENTION

The present invention is made to overcome the above-mentioned disadvantages, and accordingly, it is an object of the present invention to provide a currency sorter that facilitates retrieving and returning a fraction of a predetermined number of currency notes left unbundled and that also facilitates diagnosing failure in the bundling.

According to the first aspect of the present invention, there is provided a currency sorter comprising:

take-in means for taking currency notes in the sorter one by one, discriminating means for discriminating the currency notes;

stacking means for stacking the currency notes according to the discrimination result obtained by said discriminating means;

bundling means for bundling a predetermined number of the currency notes;

a money returning unit at which an odd currency note which is a fraction of the predetermined number of the currency notes is returned;

first conveyer means for conveying the predetermined number of the currency notes from all deposited in said stacking means with grabbing them to said bundling means; and second conveyer means for conveying the odd currency notes left in the stacking means with grabbing them to said money returning unit.

In the first aspect of the present invention, a currency sorter is provided with means for conveying currency notes from a stacking unit to a bundling unit and an additional means for conveying odd currency notes left in the stacking unit to retrieve them to a money returning unit, and therefore, an annoying task of thrusting an arm through a partial clearance of the sorter to grab and take out the notes remaining therein is no longer needed.

According to the second aspect of the present invention, there is provided a currency sorter comprising;

a main body;

take-in means for taking currency notes in said main body;

discriminating means for discriminating the currency notes, a plurality of stacking means vertically juxtaposed approximately at the center in the hind area of the main body for stacking the currency notes of predetermined categories according to the discrimination results obtained by said discriminating means;

bundling means located under the stacking means, for bundling a predetermined number of the currency notes;

a money returning unit located above the stacking means at which an odd currency note which is a fraction of the predetermined number of the currency notes being returned;

conveyer means located behind the money returning unit, the stacking means, and the bundling means and capable of moving up and down, for conveying predetermined number of the currency notes from all deposited in said stacking means to said bundling means and also grabbing the odd currency notes left in said stacking means to said money returning unit.

In the second aspect of the present Invention, the currency sorter is provided with conveyer means capable of moving up and down behind the stacking unit, the bundling unit, and the money returning unit for holding the predetermined number of the currency notes stacked in the stacking unit to transfer them to the bundling unit and for holding a fraction of the predetermined number of the currency notes left in the stacking unit to transfer them to the money returning unit. The single means of the sorter serves to transfer both the bunch of the currency notes ready to bundle and the odd money in sheets, and this simplified structure enables reduced manufacturing cost. Additionally, since the money returning unit can be located at a certain height in the front of the sorter, and the odd notes can be easily taken out.

According to the third aspect of the present invention, there is provided a currency sorter comprising:

discriminating means for discriminating currency notes taken in from a depositing slit or a stacking unit;

a plurality of stacking means for stacking currency notes to be bundled;

first conveyer means for conveying the currency notes to separately according to the discrimination results obtained by said discriminating means;

bundling means for bundling the currency notes with a band, second conveyer means for taking out a predetermined number of the currency notes from said stacking means and for convening them to said bundling means;

printing means for imprinting predetermined information on a band supplied to said bundling means; and print controller for controlling said printing means imprint information indicating one of said stacking means from which the currency notes are derived.

Information may be imprinted on a band bundling the currency notes to show if the bunch of the currency notes are only of new or old version as a result of the discriminative sorting, or if they are only of fit or unfit condition, or rather, such information may be combined with additional information about stacking unit from which the currency notes are derived from. Such a combination can be designated by a single alphabetical letter.

BRIEF DESCRIPTION OF THE DRAWINGS

FIG. 6 is a diagram showing an ordinary operation where the currency notes are sorted according to denominations without sorting out new and old versions of the notes before bundling a bunch of them with a band, FIG. 9 is a diagram showing examples of alphabetical letters that designate the fit and/or unfit conditions of the notes in a bundle derived from one of the several stacking units, and FIG. 10 is a diagram showing further examples of alphabetical letters that designate the new and/or old versions and the fit and/or unfit conditions of the notes in a bundle derived from one of the several stacking units.

DETAILED DESCRIPTION OF THE INVENTION

An embodiment of the present invention will now be described with reference to the accompanying drawings.

Figure 1:
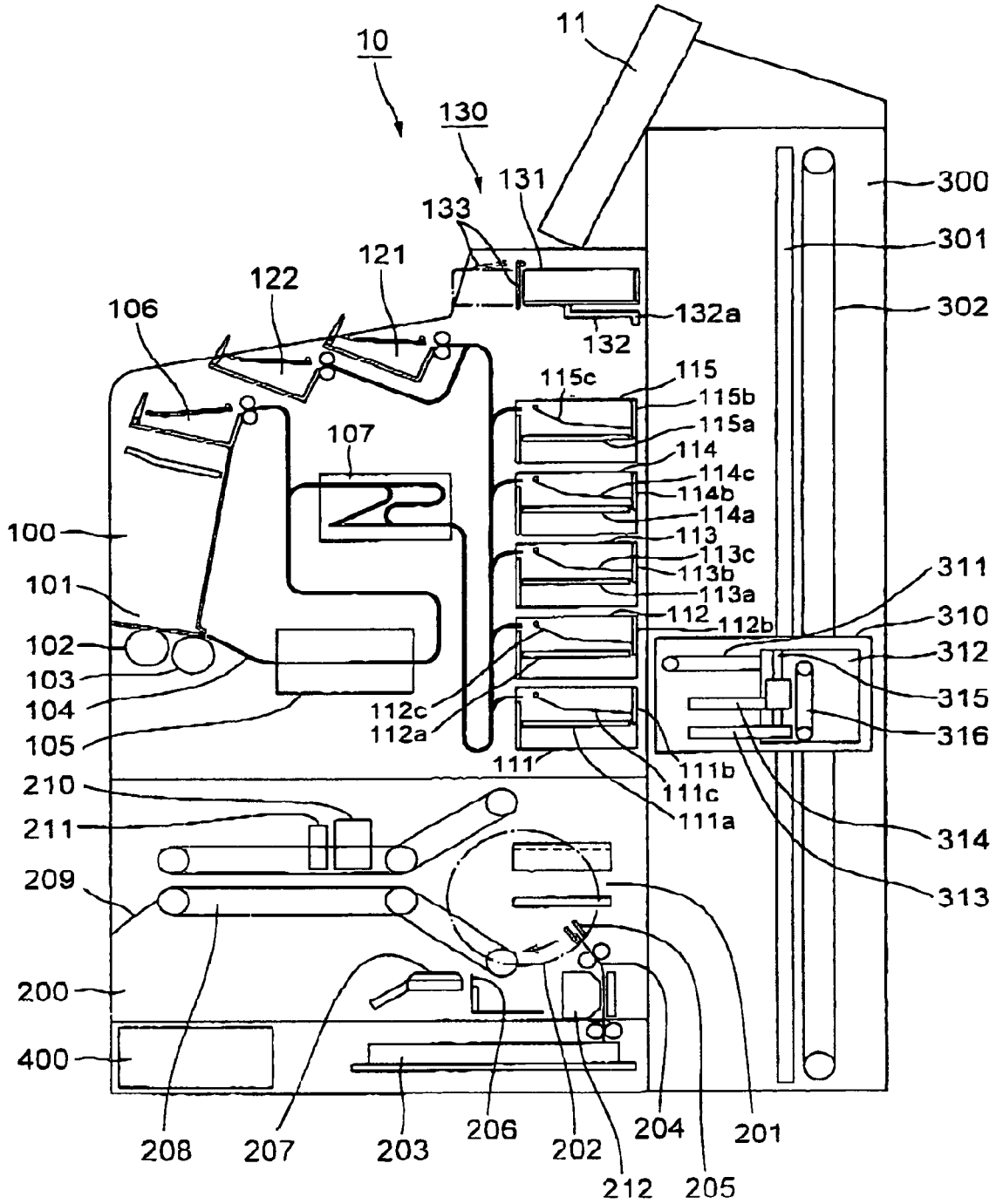
FIG. 1 is a vertical sectional view schematically showing an inner structure of an exemplary currency sorter according to the present invention.

FIG. 1 is a vertical sectional view schematically showing an inner structure of an exemplary currency sorter in accordance with the present invention.

A currency sorter 10 has an operation display unit 11 at its top, a sorter/stacking unit 100 in its upper frontal area, a bundling unit 200 in its lower frontal area, and a conveyer unit 300 at its back.

<Sorter/Stacking Unit 100>

The sorter has a receiving slit 101 approximately at the center of the front to receive currency notes, and the deposited mixed notes of various denominations are taken in by rollers 102 and 103 to convey them along on a conveying route 104.

In the middle of the conveying route 104, a discrimination unit 105 is located to identify the currency notes with denominations, fit and unfit conditions, authenticated and counterfeit entities, and front and reverse orientations. The discrimination unit 105 herein is capable of discriminating new and old design versions of the currency notes of the same denomination.

The conveying route is branched ahead of the discrimination unit 105, and as a result of the discrimination by the discrimination unit 105, the notes identified with the unfit and the counterfeit are thrown as rejected sheets in a stacking unit 106. The authenticated notes recognized as in the fit condition further undergo inspections of their respective front or reverse orientations to be stacked head to tail into a orderly heap by a front-back reversing unit 107, and thereafter, they are sorted according to other requirements and then transferred to one of stacking units 111 to 115 for the later processing of bunching and bundling with a band.

The stacking units 111 to 115 have their respective stacking stages 111*a* to 115*a* that can be moved up and down by a lift means (not shown).

In FIG. 1, the stacking units 111 to 115 are ready to load. Walls extending over upper ⅔ dimension of the stacking units, which are denoted by alphanumerical reference signs 111*b* to 115*b*, have their respective lowest ends leveled with the stages 111*a* to 115*a*, and hence, the currency notes deposited in the stacking units bump against the walls 111*b* to 115*b* and temporarily settled therein. Weight plates 111*c* to 115*c* pivot depending upon an amount of the deposited notes and press them down so as to prevent the notes from flirting out over the walls. The stages 111*a* to 115*a* and the walls 111*b* to 115*b* have their respective slits that permit a conveyer hand as mentioned below to freely move through.

On the other hand, the remaining currency notes, which are left without undergoing the subsequent bundling process, are transferred to external stacking units 121 and 122.

These stacking units 111 to 115 and the external stacking units 121 and 122 can be used to discriminatively stack various types of currency notes in various manners by varying settings depending upon the categories such as denominations, fit and unfit conditions, new and old versions of the currency notes and combinations of them. Descriptions of the settings are omitted herein since they are simply of minor concerns of the present invention.

A money returning unit 130 is located under the operation display 11, and a fraction of a predetermined number of the currency notes left in the stacking units without undergoing the subsequent process of bundling are retrieved to return therein. The money returning unit 130 has a tray 131 with a contact lever 132 extending from its bottom, and a tip 132*a* of the contact lever is pushed from behind to let the tray 131 move forward, which allows a front shutter 133 to open so as to further stuck the tray forward as depicted by dashed-dot line, thereby enabling an operator to take out the fractional number of the currency notes. Further structures and functions of this part will be detailed later.

<Bundling Unit 200>

A bundling unit 200 located under the sorter/stacking unit 100 serves to wind a band around a bunch of currency notes after a predetermined number (e.g., a hundred) of them are sorted and stacked.

The bunch of the currency notes, when reaches one hundred in number in the stacking unit 111 to 115, are transferred through the conveyer unit 300 to a stack unit 201 where the currency notes are held by pressing up and down thereon.

A rotary mechanism 202 is provided to wind bundling tape in position around the press-held currency notes, and its rotary motion makes the bundling tape 204 hold the bundle of the notes tight while a bundling mechanism 205 pinches one end of the bundling tape released from a tape box 203. Thus, after winding the bundling tape up, the end of the tape is cut by a cutter and thermally bonded by a heater 207 to bundle the notes.

The bundled currency notes are transferred on a belt conveyer mechanism 208 and stacked down to a sorter outlet 209 in the course to which provided are a stamp 210 imprinting on the bundling tape a mark of a financial company that handled and processed the notes, and another stamp 211 imprinting on the bundling tape a mark indicative of unfit notes.

A run out mechanism of the bundling tape 204 is provided with a printer 212 printing a date of the bundling process, a time of the same, a serial number of the processing machine, processing data featured according to the present invention, an identification number of a person in charge, and the like.

The bundled currency notes may be sent to the sorter outlet as in this embodiment, and alternatively, as in an apparatus disclosed in Japanese Patent Preliminary Publication No. 2003-141606, the bundled currency notes may be put in stacking in a housing.

The conveyer unit 300 at the back of the sorter transports both the currency notes ready to bundle in the following stage and the odd notes left in sheets, between the stacking units 111 to 115 and the bundling unit 200 or the money returning unit 130.

<Conveyer Unit 300>

The conveyer unit 300 is comprised of a guide shaft 301 vertically extended between lower and upper ends of the sorter, a lift unit 310 operatively engaged with the guide shaft 301 to move up and down, and a driving belt 302 used to move the lift unit 301 up and down.

The lift unit 310 has a block 312 that is operatively held on a belt mechanism 311 to move backward and forward, and the block 312 is provided with a fixed lower hand 313 and an upper hand 314 vertically movable along the shaft 315 by means of the belt 316. The hands 313 and 314 press up and down on the currency notes stacked and ready to bundle or the currency notes left in sheets in the stacking units 111 to 115 and take them out therefrom to transfer to the bundling unit 200 and the odd money returning tray 131 of the money returning unit.

Figure 2:
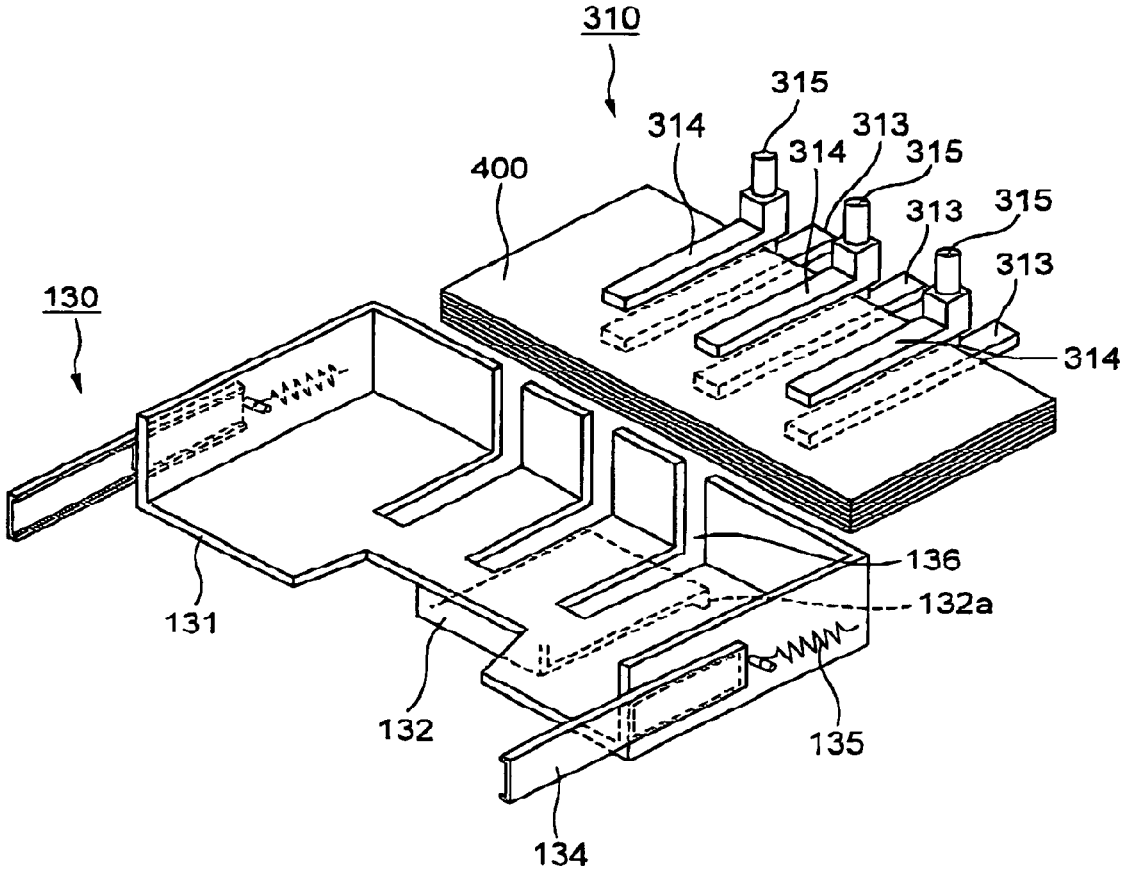
FIG. 2 is a perspective view showing a cooperative relation of a lift unit with a money returning unit.

FIG. 2 is a perspective view showing a cooperative relation of the lift unit 310 with the money returning unit 130.

The odd money returning tray 131 is a component having walls at its lateral sides and backside, and a slide rail 134 provided on the lateral sides permits the tray to slide forward and backward. Several extension springs 135, having their respective one ends attached to the lateral sides of the odd money tray, continually urge the tray toward the conveyer unit 300.

FIG. 2 partially depicts the lift unit 310, and upper hands 314 are also shown being engaged respectively with three guide shafts 315 to move up and down, thereby assuredly holding currency notes between the upper hands 314 and fixed lower hands 313.

The tray 131 is provided with three slits 136 that permit the upper and lower hands 314 and 313 freely to pass through, and an extension of the slit 136 is greater than a length of grabbers of the upper hands 314.

The tray 131 has the contact lever 132 at its bottom. The contact lever 132 bends twice; that is, it extends down from the bottom of the tray by a distance sufficiently greater than a thickness of the lower hand 313, and then turns horizontally backward, and this horizontal portion is followed by an additional downward extension. The contact lever 132*a* is mated with the upper and lower hands 314 and 313 and is pushed forward along with the tray 131 so as to return the odd currency notes.

Referring now to FIGS. 3 and 4, the functions of the conveyer unit 300 will be described in detail.

FIG. 3 illustrates a sequence of steps in taking out the currency notes ready to bundle or the odd notes from the stacking unit. An example of evacuating the currency notes from the lowermost stacking unit 111 will now be described.

First, a lift means (not shown) makes the stage 111*a* go down to the lowest level in the stacking unit 111. The lift unit 310 also goes down along the guide shaft 301 by means of the belt 302, to a predetermined level relative to the target stacking unit 111, namely, to a level where an upper surface of the lower hand 313 is lower than the currency note at the bottom of the bundle 400. The belt 316 works to raise the upper hand 314 to a level where its lower surface is higher than the currency note at the top of the bundle 400. This leads both the hands 313 and 314 to their respective open positions.

Figure 3A:
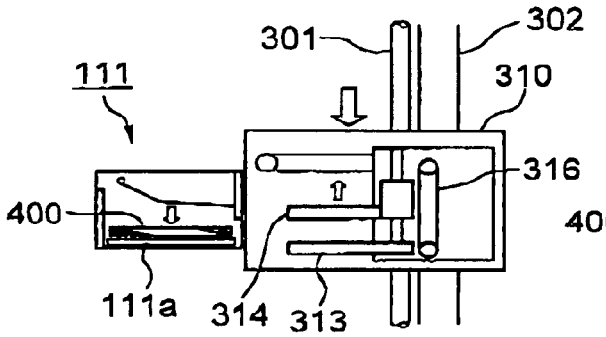
FIGS. 3A to 3D are diagrams showing a sequence of actions of the sorter to take out a batch of or a fraction of a predetermined number of currency notes from a stacking unit.
Figure 3B:
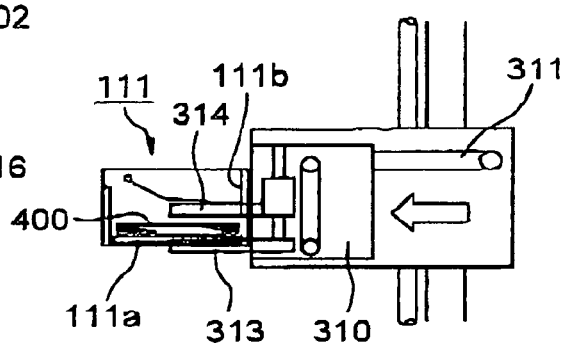

Then, as shown in FIG. 3B, the belt 311 moves to advance the block 312 to leave the bundle of the currency notes 400 between the upper and lower hands 314 and 313. During this action, the slits in the wall 111*b* and the stage 111*a* letting the hands pass through, there is no conflict between these components.

Figure 3C:
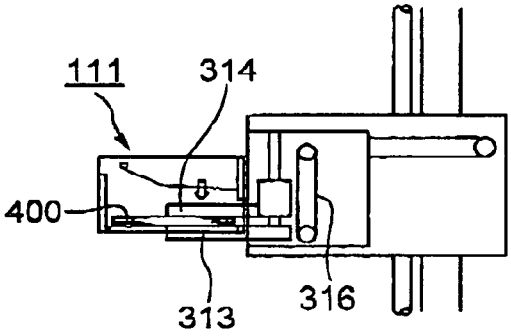

As can be seen in FIG. 3C, the belt 316 works to make the upper hand 315 go down, and the upper hand 314 along with the lower hand tightly hold the bundle of the currency notes 400 there between.

Figure 3D:
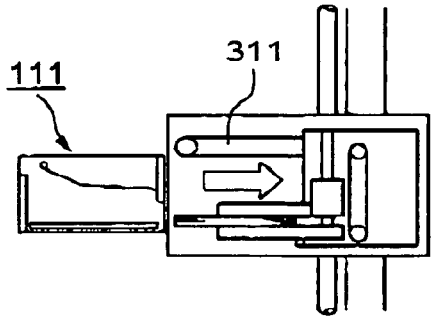

Further, as will be recognized in FIG. 3D, the belt 311 moves to enable the block 312 to recede, and hence, both the hands 313 and 314, while holding the bundle of the currency notes 400, become movable upward and downward together. Thus, when the currency notes reach the predetermined number and are ready to undergo the bundling with the tape, the lift unit goes down to the level of the bundling unit 200, and when they are odd in number, the lift unit goes up to the level of the odd money returning unit 130.

After evacuating the stacking unit 111, the stage 111*a* in the stacking unit is raised to its initial standby position.

FIG. 4 illustrates a sequence of actions of the lift unit 310 relative to the odd money returning unit 130.

Figure 4A:
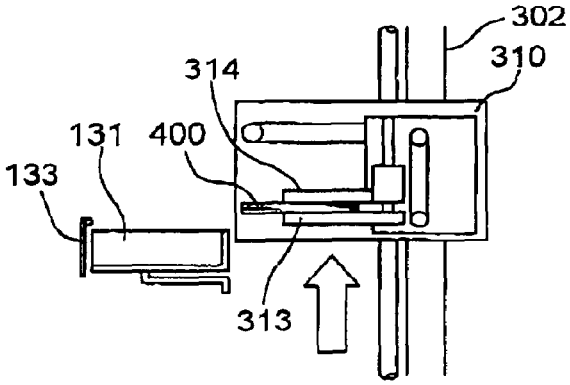
FIGS. 4A to 4F are diagrams showing a sequence of actions of the lift unit relative to the odd money returning unit.

Referring to FIG. 4A, the belt 302 is driven while both the hands 313 and 314 hold the odd notes as shown in FIG. 3D, and thus, the lift unit 310 goes up. The odd notes 400 are raised to a position higher than the level of the wall of the tray 131.

Figure 4B:
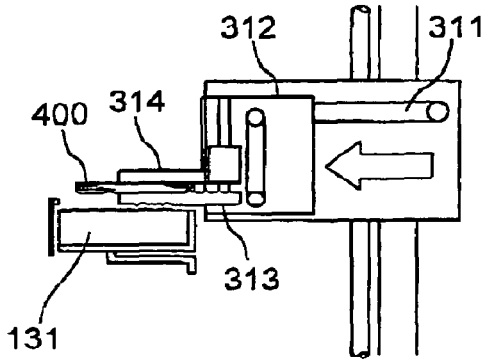

Then, as shown in FIG. 4B, the belt 311 is driven to advance the block 312 to a position where the entire extension of the odd notes 400 falls in a range of the emptiness in the tray 131 fit under.

Figure 4C:
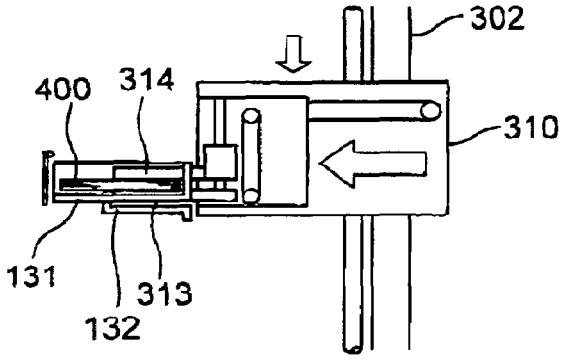

After that, as shown in FIG. 4C, driving the belt 302 causes the whole lift unit 310 to go down, and the slit 136 provided in the tray 131 permits the lower hand 313 to freely pass through. In this stage of the process, it is preferable to position an upper surface of the lower hand 313 so as to be flat with an inner bottom surface of the tray 131. In this way, the odd notes 400 are entirely accommodated in the tray 131.

Figure 4D:
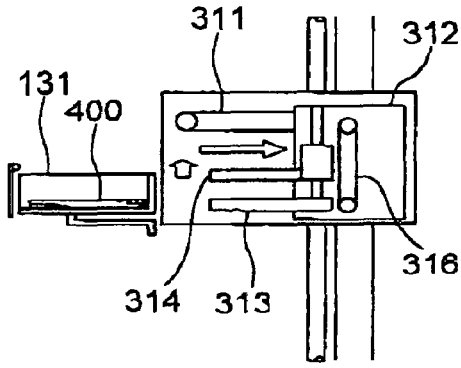

As in FIG. 4D, the belt 311 and the belt 316 are simultaneously driven to make the upper hand 314 go up and make the block to recede. Thus, the odd notes 400 are released and left in the tray 131.

Then, the belt 316 is driven to move the upper hand 314 downward till it comes in contact with the lower hand 313, and the belt 302 is further driven to move the lift unit 310 downward till the hands reach a level where they are to comes in contact with a contact 132*a* of the contact lever 132.

Figure 4E:
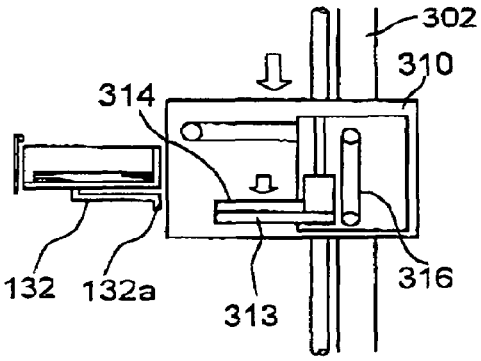
Figure 4F:
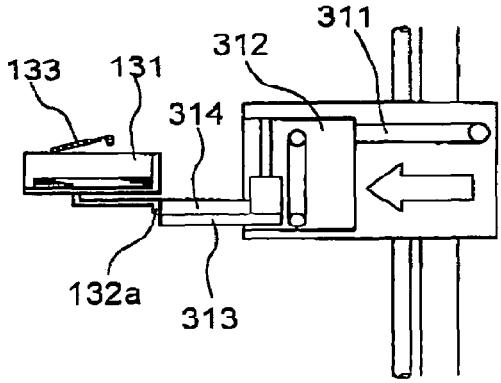

Subsequently, as depicted in FIG. 4F, as the belt 311 is driven to advance the block 312, the hands 313 and 314 push the contact lever 132*a*, and this results in the whole tray 131 being stuck forward. The shutter 133, which is located ahead of the tray 131, pivots about a rotation axis attached at its upper portion, and this allows the tray to slide under the shutter to the outside of the sorter, thereby facilitating to pick the currency notes up. Thus, FIGS. 4E to 4F depict the steps of returning the currency notes.

After completing the returning procedure, as a sensor (not shown) detects that the odd notes have been evacuated from the tray, the block 312 is forced to recede and urge the extension spring 132 in FIG. 2 to pull the tray backward, and the shutter 133 is closed and ready for the next sequence.

Eliminating a dedicated drive means for moving the tray forward and backward beneficially brings about the reduced manufacturing cost and the downsizing of the currency sorter, as a whole.

As has been described, the currency sorter according to the present invention facilitates taking out the odd notes left in sheets without undergoing the bundling process, and this is unlike a prior art currency sorter in that this embodiment no longer necessitate an annoying sequence of the steps of opening part of the sorter to grab and remove the odd notes.

The processes of conveying the currency notes to the bundling unit and conveying the odd notes to the odd money returning unit share the same conveyer means, and this also simplifies the structure of the currency sorter and contributes to the cost reduction. The odd money returning unit can be set in a higher position in the front of the sorter, and this enhances accessibility to the notes in the sorter to satisfactorily get rid of the clumsy manipulation in the prior art embodiment.

Thorough evacuation of the odd currency notes from the sorter can be conducted by applying the sequences as in FIGS. 3 and 4 to all the stacking units.

In such a manner, conducting the sequence of the returning for each stacking unit, the returning of the odd notes can be supervised for individual categories of the bundled currency notes, as desired in an administrative point of view.

The odd notes derived from more than one stacking units may be gathered in the tray 131 so as to pick them all up in the odd money returning unit.

In such a manner, evacuating the tray only once enables to return all the odd notes, as intended to attain more efficient operation.

The sequence of the aforementioned process steps can be preprogrammed so as to control in each of the units of the sorter, and such preprogramming facilitates a retrieval of the odd notes, for example, by simply pressing a return button.

There is only one lift unit in the above-mentioned embodiment, but two lift units of the same type can be engaged with the guide shaft; i.e., the lower one is dedicated to the transportation of the batch of the notes ready to bundle while the upper one is used only for retrieving the odd notes. In this way, the sequence of the operation steps can be quickened. Two of the lift units are as defined as first and second conveyer means in claim 1 appended hereto.

<Control Unit 400>

A control unit 400 is provided to control the total operation of the currency sorter as a whole. The control unit 400 has a microprocessor serving as the control means, and a communication means using communication line for connecting the microprocessor with a supercomputer such as the one introduced in the center of a financial company or organization. Such a communication means serves to send data on all the circumstances within the currency sorter one after another to the super computer.

The control unit 400 also functions as a printer control unit that determines letters to print on the bundling tape in response to the process command given by an operator and to actual processing situations, so as to give print instructions to a printer 212.

In FIG. 1, the control unit 400 is depicted residing under the bundling unit 200 for convenience sake, but it can be placed in any spatially available part within the sorter, as a matter of the design, for example, behind the operation display unit 11.

In the currency sorter configured as stated above, the present invention provides an improved design of the stacking units of the currency notes ready to bundle with the tape and the external stacking units of the notes to be left unbundled, which can be respectively allocated to individual categories of the currency notes according to their respective denominations, fit and unfit conditions, new and old versions, and so forth.

Figure 5:
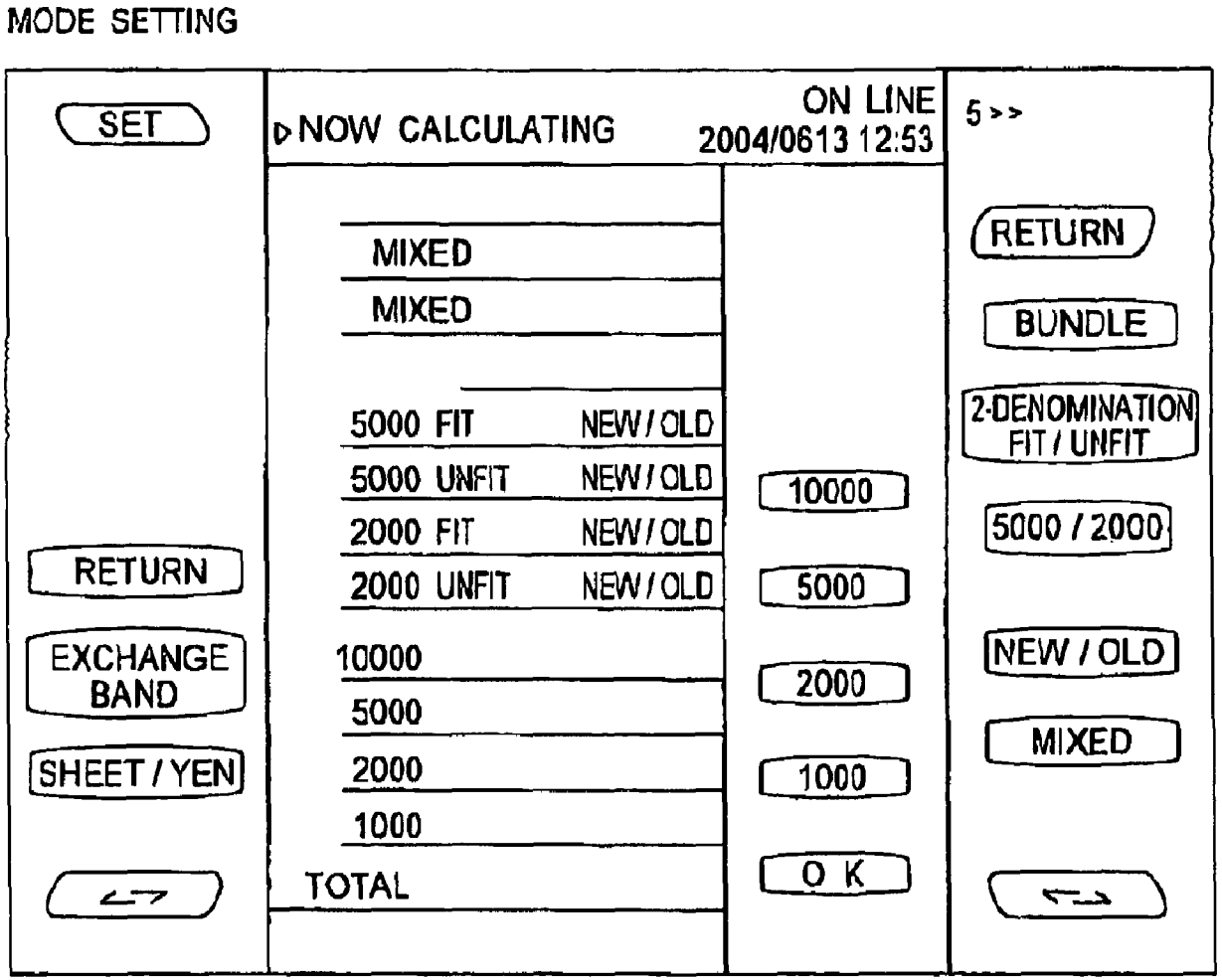
FIG. 5 is a diagram showing an example of a mode setting screen presented on an operation display during bundling a bundle of currency notes with a band.

FIG. 5 shows an exemplary mode setting screen presented in the operation display, which is evoked as a result of touching the uppermost setting button in the leftmost column. The screen is configured in a touch panel that presents guidance to various manipulations of the sorter only by letting the operator touch some part on the screen.

There are various setting buttons in the leftmost, rightmost, and second rightmost columns in the screen, and the operator touches the buttons to select the denominations, conditions, and versions of the currency notes to dump in the stacking units and the external stacking units.

The second leftmost column gives the descriptions of the settings selected for each stacking unit and values of the money handled. The uppermost and second uppermost rows show the settings in relation to the external stacking units 121 and 122, and the next four rows show the settings relative to the stacking units 111 to 114. The stacking unit 115 is of a supplemental use in case that any of the stacking units 111 to 114 becomes full.

FIG. 5 shows an example of the mixed notes stacked in two of the external stacking units 121 and 122, and the fit 5,000-yen notes of both the new and old versions, the unfit 5,000-yen notes of both the versions, the fit 2,000-yen notes of both the versions, and the unfit 2,000-yen notes of both the versions stacked in four of the stacking units 111 to 114, respectively. The terms "mixed" and "of both the new and old versions" will be explained later.

The remaining part of the screen below these setting descriptions gives the subtotals for the notes of the individual denominations and the total for the all.

FIG. 6 is a diagram showing an example of various settings of the processing on the currency sorter according to the present invention.

A case depicted in FIG. 6 is the normal non-discriminative handling of the notes of the old version from those of the new version, and the denominations of the currency notes to bundle with the tape are selected.

In more detail, the selected mode is a bundling mode where the denominations of the notes to bundle with the tape are to be selected. The bundling mode is an initial value (default value).

As shown in FIG. 1, there are five of the stacking units which are enough in number to respectively allocate to the individual denominations of 10,000 yen, 5,000 yen, 2,000 yen, and 1,000 yen. Allowing for an actual amount passed in the market, the default value is selecting all of the four denominations, and any combination of single, double and triple denominations can also be selected from the four of them since it is not always desired to bundle the all. The initial value can vary among 10,000 in selecting the single denomination, 10,000 and 1,000 in selecting the double denominations, and 10,000, 5,000 and 1,000 in selecting the triple denominations, and this also can be changed to any single denomination or any combination of the denominations as desired.

For all the denominations and the combinations thereof, an additional selection can be made according to the conditions of the notes, namely, fit or unfit. More specific discrimination is made among the fit notes of good condition, the unfit notes of poor condition, the mixed fit notes, and the mixed unfit notes so that one of them can be selected, although the initial value is the fit notes. The "mixed fit notes" are a batch of the currency notes that are stacked without discrimination of the fit notes from the unfit notes and then bundled where the unfit notes in the bundle are exceptionally regarded as the fit notes. The "mixed unfit notes" are a batch of the currency notes under the mixed condition of fit and unfit, and after bundled, they have a mark indicating "unfit" stamped on the bundling tape.

There is still another choice between the new and old versions of the currency. When the currency is changed in design, the new and old conditions can be designated for only the notes of the denomination(s) of which design has been renewed, or rather, the conditions may be designated without discrimination of the old version from the new version. The initial value is the new version.

As has been described, since the stacking units are allocated to the individual categories according to the denominations, conditions, and versions of the notes, and the notes which do not fall in the categories are regarded as being not ready to bundle and transferred to the external stacking units instead of the built-in stacking units.

The currency notes sent to the external stacking units can include some other categories designated by the settings. In this embodiment, there are two of the external stacking units, and therefore, there is a choice among discriminating between the fit and unfit conditions, discriminating between the new and old versions, and dumping the mixed without such discrimination.

In dumping the fit and unfit notes separately, for example, the external stacking unit 121 stacks the fit notes not falling in the categories designated as ready to bundle with the tape while the external stacking unit 122 stacks the unfit notes or the mixed notes out of the above designation. Such a discriminative stacking enables the unfit currency notes to be eliminated so that only the fit notes are to be handled in the succeeding steps, and this is advantageous to enhance the operation efficiency.

In dumping the notes of the new and old versions separately, for instance, the external stacking unit 121 stacks the new notes out of the designation as ready to bundle with the tape while the external stacking unit 122 stacks the old notes out of the same designation. Such a discriminative stacking ensures to eliminate the currency notes of the old version not to be passed in the financial market.

Under the setting of a choice of the mixed notes, when the external stacking unit 121 becomes stuffed (typically with two hundreds of the notes), the external stacking unit 122 is supplementally used. While the notes are being stacked into the external stacking unit 122, evacuating the external stacking unit 121 makes it ready for supplemental use instead of the stacking unit 122 when it becomes full later. The currency notes stacked in and evacuated from the external stacking unit have their respective categories checked and presented with definite data on the display unit, and the data are preferably sent to the super computer via the communication means of the control unit 400.

In the currency note sorting/bundling unit according to the present invention, presuming that the settings can be widely varied, the categories of the notes and the allocation of the stacking units are symbolized as information about the stacking units and marked on the bundling tape of the bundle.

Figures 7, 8:
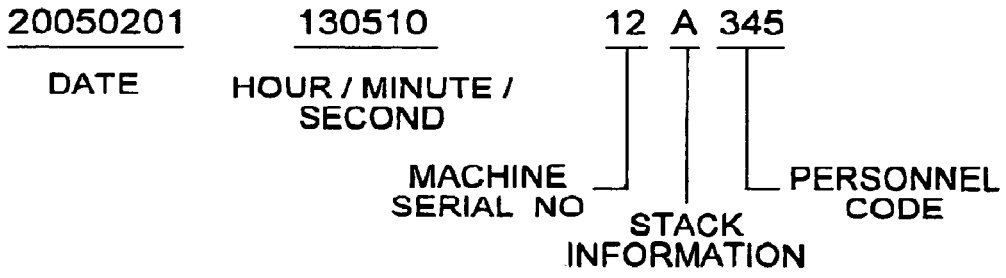
FIG. 7 is a diagram showing an example of contents printed in the bundling band.
FIG. 8 is a diagram showing examples of alphabetical letters that designate the new and/or old versions of the notes in a bundle derived from one of several stacking units.

FIG. 7 shows an example of printed marks and descriptions of the same, which is divided into five segments.

The first segment includes eight digits indicating the date in Christian year. The second segment represents the time in hours/minutes/seconds on the 24-hour-clock basis. The third group includes a serial number indicative of the type of the machine, and the number of digits depends on a factor such as a scale of the financial company, which may be sometimes of as much as three digits. The fourth group is a conspicuous part of the present invention, representing the information about the currency notes in stacking. The last or fifth group contains the information about a person in charge, and if there are more than one staff members in charge, the number of digits can be appropriately increased.

FIGS. 8 to 10 are diagrams illustrating the information about the currency notes in stacking in detail. The "information about the currency notes in stacking" is comprehensively referred to the data about the stacking units, the new and old versions of the notes, the fit and unfit conditions of the notes, and the like.

In FIG. 8, when selected is a mode of discriminatively dumping the notes of the new version from those of the old version, the first to fifth stacking units are designated by alphabets A to E, respectively, and in a mode of stacking the mixed notes of the old and new versions, the first to fifth stacking units are designated by G to K.

Determining the settings as in the above, for example, in the mode of selecting the mixed notes of the new and old versions (i.e., the batch of the mixed notes of both the versions are to be bundled), when the notes of 10,000 yen are stacked in the first stacking units 111 in FIG. 1 and then bundled in the bundling unit 200, a mark G is printed on the bundling tape wound on the notes.

A glimpse at the printed alphabetical letter is sufficient to instantaneously let a staff member know which stacking unit the batch of the notes were stacked in before they were bundled and also let him or her detect which mode the notes of the new and old versions are bundled, discriminative or mixed.

Thus, in the event that the currency notes in an orderly stack have their corners bent and that the bundling state is unsatisfactory due to the notes stacked awkwardly, the category designation G to all the unsatisfactorily bundled currency notes would help the staff member draw a conclusion that the first stacking unit is the spot of such malfunction, thereby bringing about a quick diagnosis and solution.

Also, in the event that all the notes but one in the same bundle are of new versions to make the user suspect an error in the sorting and bugs in software program, the information on the notes in stacking, which are printed in the bundling tape, let the staff member instantaneously know the settings determined to bundle the notes, thereby helping both the user and the manufacturer shoot a trouble without conflict to each other.

In FIG. 9, the currency notes are categorized according primarily to the fit and unfit conditions of the notes. Specifically, in the mode of stacking the fit and unfit notes separately, the first to fifth stacking units are designated by alphabetical letters O to S, respectively, while in the mode of stacking both the fit and unfit notes together, the first to fifth stacking units are designated by V to Z.

There are 26 alphabetical letters, and any combination of the examples in FIGS. 8 and 9 can be represented by them.

FIG. 10 illustrates such a combination: In the mode of sorting out the fit and unfit conditions and the new and old versions, the first and fifth stacking units are designated by alphabetical letters A to E, respectively; in the mode of sorting the mixed notes of the new and old versions according to the fit and unfit conditions, the first to fifth stacking units are designated by G to K; in the mode of sorting the mixed notes of the fit and unfit conditions according to the new and old versions, the first to fifth stacking units are designated by O to S; and in the mode of stacking the mixed notes of the new and old versions and the fit and unfit conditions together, the first to fifth stacking units are designated by V to Z.

In this way, since a single alphabetical letter is useful to record a variety of categories of the notes, it becomes easier to trace what caused a trouble, and this is especially advantageous when only a restricted number of letters are printed on the bundling tape.

Although, in this embodiment, only one alphabetical letter is used, a larger number of alphanumeric letters in combination can represent increased combinations of the categories of the notes. In addition, using Japanese hirakana letters or katakana letters, 50 combinations of the categories of the notes can be denoted by 50 different letters.

The categories of the currency notes includes almost all requirements as well as the data on the stacking units, the new and old versions of the notes, and the fit and unfit conditions of the notes as in the above, so far as they can be designated by the usable letters restricted in number.

Structures, configurations, positions, materials, and the like of the components in the aforementioned embodiments may be modified without departing from the true scope of the present invention.

What is claimed is:

1. A currency sorter comprising:

take-in means for taking currency notes in the sorter one by one;

discriminating means for discriminating the currency notes;

stacking means for stacking the currency notes according to the discrimination result obtained by said discriminating means;

bundling means for bundling a predetermined number of the currency notes;

a money returning unit at which an odd currency note which is a fraction of the predetermined number of the currency notes is returned, and conveyer means for conveying the currency notes in first and second modes, in which in the first mode the predetermined number of the currency notes from all deposited in said stacking means are grabbed and conveyed to the bundling means; and in the second mode the odd currency notes left in the stacking means are grabbed and conveyed to said money returning unit.

2. The currency sorter according to claim 1, wherein there are more than one stacking means allocated to categories of the currency notes such as denominations, fit and unfit conditions, new and old versions, and the like; and said currency sorter is configured that the odd currency note is retrieved from each of said stacking means and conveyed to said money returning unit, and a sequence of returning the currency notes is repeated each time the odd currency note is retrieved from one of the stacking means and conveyed to said money returning unit.

3. The currency sorter according to claim 1, wherein there are more than one stacking means allocated to categories of the currency notes such as denominations, fit and unfit conditions, new and old versions, and the like; and said currency sorter is configured that the odd currency note is retrieved from each of said stacking means and conveyed to said money returning unit, and a sequence of returning the currency notes is conducted once after the odd currency notes retrieved from all said stacking means and conveyed to said money returning unit.

4. The currency sorter according to claim 1, wherein said stacking means has a plurality of stacking units, said stacking units being vertically juxtaposed approximately at the center in the hind area of a main body;

said bundling means being located under said stacking means, said money returning unit being located above the stacking means and at a position facing a front side of the main body, and said conveyor means being located behind the money returning unit, said plurality of stacking units, and the bundling means and capable of moving up and down, for conveying a predetermined number of the currency notes from all stacked in said plurality of stacking units to said bundling means and also for conveying the odd currency notes left in said stacking means with grabbing to said money returning unit.

5. The currency sorter according to claim 4, wherein the conveyer means includes:

hand members pressing up and down on a batch of the currency notes to hold them all therebetween;

a horizontal movement mechanism for moving said hand members forward and backward; and a vertical movement mechanism for moving said hand members upward and downward;

and wherein the money returning unit includes a tray in which the odd currency notes are stacked by said hand members, the tray being able to move forward and backward and having a mating member fitted on said hand member during the horizontal movement of said hand member; and said tray being stuck forward as a result of the horizontal movement of the conveyer means, so that the odd currency notes can be picked up from the tray outside the main body of the sorter.

6. The currency sorter according to claim 1 wherein said conveyor means includes two portions, one of which performing the first mode operation and the other of which performing the second mode operation.

* * * * *

UNITED STATES PATENT AND TRADEMARK OFFICE

CERTIFICATE OF CORRECTION

PATENT NO. : 7,628,279 B2
APPLICATION NO. : 11/243268
DATED : December 8, 2009
INVENTOR(S) : Sekiguchi et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 890 days.

Signed and Sealed this

Second Day of November, 2010

David J. Kappos

David J. Kappos
*Director of the United States Patent and Trademark Office*